US009102170B2

(12) United States Patent
Hanamoto et al.

(10) Patent No.: US 9,102,170 B2
(45) Date of Patent: Aug. 11, 2015

(54) PRINTER AND STORAGE MEDIUM

(71) Applicant: RISO KAGAKU CORPORATION, Tokyo (JP)

(72) Inventors: Yoshihiro Hanamoto, Tsukuba (JP); Yoshikazu Hara, Tsukuba (JP); Hideaki Ogawa, Tsukuba (JP); Kazuaki Mori, Tsukuba (JP); Hiroaki Takanohashi, Tsukuba (JP); Yousuke Minowa, Tsukuba (JP); Yoshiaki Kono, Tsukuba (JP)

(73) Assignee: RISO KAGAKU CORPORATION (JP)

( * ) Notice: Subject to any disclaimer, the term of this patent is extended or adjusted under 35 U.S.C. 154(b) by 0 days.

(21) Appl. No.: 14/337,791

(22) Filed: Jul. 22, 2014

(65) Prior Publication Data

US 2015/0035892 A1 Feb. 5, 2015

(30) Foreign Application Priority Data

Jul. 30, 2013 (JP) ..... 2013-158234

(51) Int. Cl.
*B41J 29/38* (2006.01)
*B41J 13/00* (2006.01)
*B42C 1/00* (2006.01)

(52) U.S. Cl.
CPC ..... *B41J 13/0009* (2013.01); *B42C 1/00* (2013.01)

(58) Field of Classification Search
CPC ..... B41J 11/42; B41J 29/393; B41J 29/38; B41J 3/60; B41J 11/0095
USPC ..... 347/16, 104
See application file for complete search history.

(56) References Cited

U.S. PATENT DOCUMENTS

2002/0041405 A1* 4/2002 Kutsuwada et al. ..... 358/514
2002/0060388 A1* 5/2002 Wakabayashi et al. .... 270/58.08
2007/0014614 A1* 1/2007 Yoshida ..... 400/62
2013/0038892 A1* 2/2013 Morita ..... 358/1.14

FOREIGN PATENT DOCUMENTS

JP 2008-094024 A 4/2008

* cited by examiner

*Primary Examiner* — Manish S Shah
*Assistant Examiner* — Yaovi Ameh
(74) *Attorney, Agent, or Firm* — Schwegman Lundberg & Woessner, P.A.

(57) ABSTRACT

A printer which is connected to a post-processing apparatus, the post-processing apparatus performing a wrapped binding in which a paper sheet bundle including a plurality of inner paper sheets is wrapped by outer paper sheets, and which prints the outer paper sheets and inner paper sheets to be sent out to the post-processing apparatus, wherein the printer includes a control unit configured to control printing of the inner paper sheets and the outer paper sheets in cooperation with the post-processing apparatus, and the control unit is configured to set printing restart information of inner paper sheets and printing restart information of outer paper sheets, and controls a restarting of printing in accordance with the setting, when printing is restarted after an abnormal conveyance that occurred inside of the post-processing apparatus has been resolved.

4 Claims, 5 Drawing Sheets

PRINTER AND STORAGE MEDIUM

CROSS-REFERENCE TO RELATED APPLICATION

This application is based upon and claims the benefit of priority of the prior Japanese Patent Application No. 2013-158234, filed on Jul. 30, 2013, the entire contents of which are incorporated herein by reference.

BACKGROUND OF THE INVENTION

1. Field of the Invention

The present invention relates to a printer which is connected to a post-processing apparatus that includes a bookbinding mechanism and a storage medium.

2. Description of the Related Art

Various developments have been made for a printing system which is made up of a printer and a post-processing apparatus (also referred to as a bookbinding apparatus) that includes a bookbinding function to bind paper sheets printed by the printer. The post-processing apparatus is provided with a matching mechanism that matches a plurality of printed inner paper sheets (text sheets) to form a paper sheet bundle. At a position separated from the matching mechanism, a binding mechanism (a binding unit) is provided which files the paper sheet bundle that was sent out from the matching mechanism in a state of being covered by a printed outer paper sheet (a cover sheet). Further, at an outlet side of the binding mechanism, a receiving box that receives a booklet sent out from the binding mechanism is provided.

By making the post-processing apparatus operate (by driving the post-processing apparatus), the matching mechanism matches a plurality of printed inner paper sheets to form a paper sheet bundle, and the binding mechanism files the paper sheet bundle in a state of being covered by a printed outer paper sheet. With this, a booklet is prepared and sent out to a receiving box, and a plurality of booklets are accumulated in the receiving box.

Since two kinds of paper sheets associated with each other inside of the post-processing apparatus are conveyed, outer paper sheets and inner paper sheets, when jamming occurs in some parts, determining a printing content to be restarted according to the situation becomes necessary. For example, a system is proposed in which a printing content to be restarted is determined according to a position at which jamming has occurred and according to whether or not paper sheets exist in the matching mechanism (Japanese Laid-open Patent Publication No. 2008-94024).

SUMMARY OF THE INVENTION

In bookbinding processing, printing inner paper sheets often takes time. Therefore, for the purpose of reducing the time for bookbinding, in a printing system, outer paper sheets are printed when printing of inner paper sheets has ended, and this is followed by binding of the inner paper sheets and the outer paper sheets which are in a shape of booklets so processing such as pasting of wrapped binding can be performed. During this earlier bookbinding processing, inner paper sheets for the following booklet are printed and, at a post-processing apparatus, printed inner paper sheets are also accumulated simultaneously.

As a result, when an abnormal conveyance (jamming) has occurred inside of a post-processing apparatus (a bookbinding apparatus), if printing is restarted after a release of a jam, some problems may arise.

For example, when an abnormal conveyance (jamming) has occurred in outer paper sheets that are in the process of being conveyed at a post-processing apparatus, printing of inner paper sheets for the following booklet that is performed in parallel at a printer is interrupted, and together with this, accumulation of printed inner paper sheets at the post-processing apparatus is also interrupted. After a releasing of a jam of the outer paper sheets, the printer restarts printing from the outer paper sheets, but due to the interruption, the printing of the inner paper sheets for the following booklet is also reset, and the printing of the inner paper sheets is performed from a top page once again. Therefore, at the time of restarting, printed inner paper sheets that have accumulated in the post-processing apparatus up to a page part way in must be disposed of.

In view of the above mentioned problem, the present invention intends to provide a printer capable of restarting printing from positions that are appropriate respectively for the inner paper sheets and the outer paper sheets after the occurrence of an abnormal conveyance at a post-processing apparatus.

In order to achieve the above mentioned object, the present invention provides a printer which is connected to a post-processing apparatus, the post-processing apparatus performing a wrapped binding in which a paper sheet bundle including a plurality of inner paper sheets is wrapped by outer paper sheets, and which prints the outer paper sheets and inner paper sheets to be sent out to the post-processing apparatus, wherein a conveying control unit configured to control such that there is at least some overlap of parts of a conveyance time period during which the outer paper sheets that were printed are conveyed to a wrapped-binding mechanism and a conveyance time period during which the inner paper sheets that were printed are loaded into an inner paper sheet loading unit is provided in the post-processing apparatus, the printer including a control unit configured to control printing of the inner paper sheets and the outer paper sheets in cooperation with the post-processing apparatus, and the control unit setting printing restart information of inner paper sheets that is a print restarting point of the inner paper sheets and printing restart information of outer paper sheets that is a print restarting point of the outer paper sheets, and controlling a restart of printing in accordance with the setting, when printing is restarted under a condition in which there is at least some overlap of parts of the conveyance time periods and after an abnormal conveyance of the outer paper sheets or the inner paper sheets that occurred inside of the post-processing apparatus has been resolved.

According to the present invention, a printer can be provided that is capable of restarting printing from positions that are appropriate for the inner paper sheets and the outer paper sheets respectively, after the occurrence of an abnormal conveyance at a post-processing apparatus.

DETAILED DESCRIPTION OF THE PREFERRED EMBODIMENTS

Figure 1:
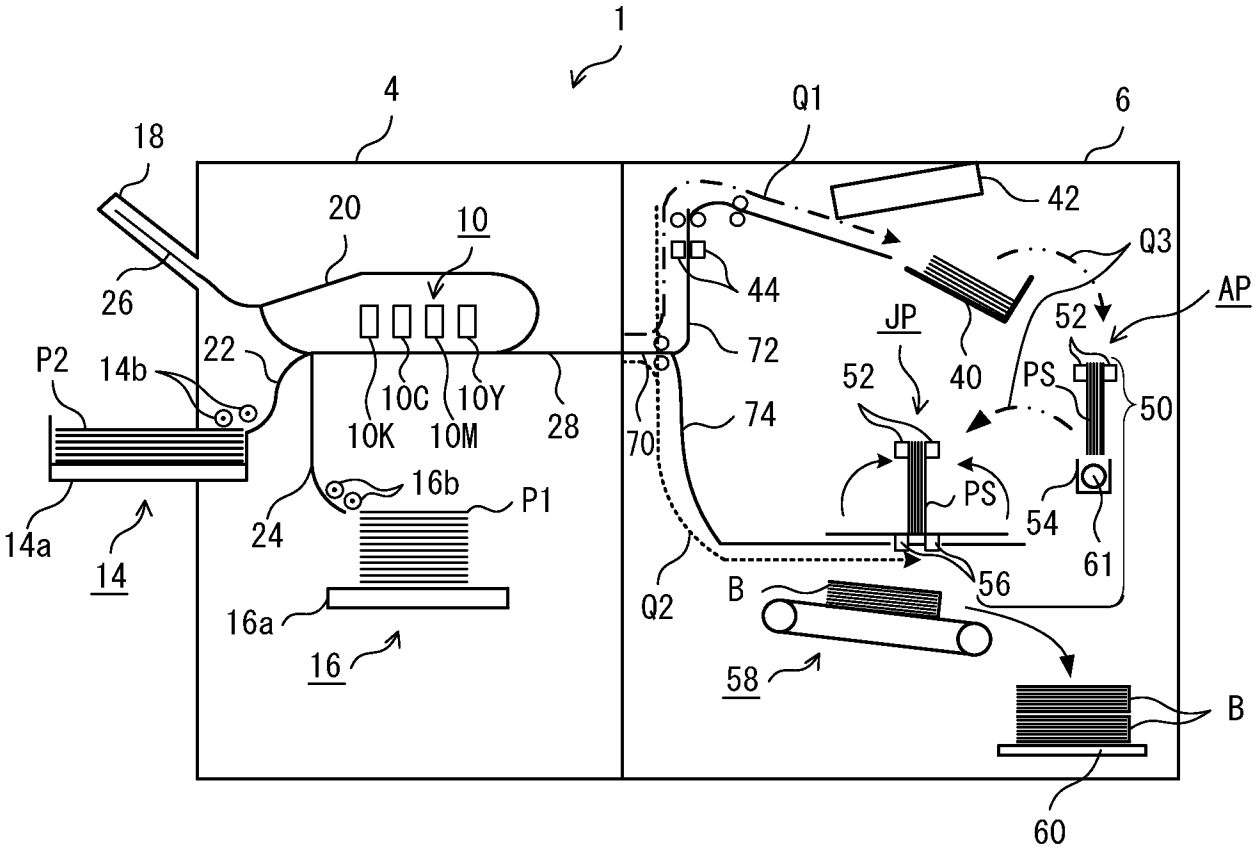
FIG. 1 illustrates a main mechanism configuration of a printing system 1.

Hereinafter, explanations are given for embodiments of the present invention in reference to drawings. FIG. 1 illustrates a main mechanism configuration of a printing system 1. A printing system 1 according to the embodiments of the present invention is a system for preparing a booklet B by printing an outer paper sheet P2 that is a cover sheet and inner paper sheets P1 that are a plurality of text sheets, and by performing bookbinding processing on the printed inner paper sheets P1 and a plurality of outer paper sheets P2 (referred to as a paper sheet bundle PS).

Namely, the printing system 1 includes a combination of a printer 4 which prints a plurality of inner paper sheets P1 and outer paper sheets P2, and a post-processing apparatus 6 (a bookbinding apparatus) which is provided at a position adjacent to the printer 4 and which has a bookbinding function for the printed inner paper sheets P1 and outer paper sheets P2.

The printer 4 has a printing mechanism (a printing unit) 10, an outer paper sheet feeding unit 14, an inner paper sheet feeding unit 16, a cassette 18, and a conveying path.

The printing mechanism 10 is an ink-jet printing mechanism which prints a plurality of inner paper sheets P1 and outer paper sheets P2, on the basis of image data (cover sheet image data and text image data). The printing mechanism 10 includes a plurality of line-type ink heads 10K, 10C, 10M, and 10Y that discharge inks in colors of black, cyan, magenta, and yellow, respectively.

An outer paper sheet feeding unit 14 feeds outer paper sheets P2 to the printing mechanism 10, and is positioned at a left side part of the printer 4. The outer paper sheet feeding unit 14 includes a paper feed tray 14*a* that loads a plurality of outer paper sheets P2 and a plurality of paper feed rollers 14*b* that send out the outer paper sheets P2 that were loaded into the paper feed tray 14*a*, to the printing mechanism 10.

The inner paper sheet feeding unit 16 feeds inner paper sheets P1 to the printing mechanism 10, and is positioned at a lower side of the printing mechanism 10. The inner paper sheet feeding unit 16 includes a paper feed tray 16*a* that loads a plurality of inner paper sheets P1 and a plurality of paper feed rollers 16*b* that sequentially send out the inner paper sheets P1 that were loaded into the paper feed tray 16*a*, to a side of the printing mechanism 10.

The cassette 18 temporarily stores inner paper sheets P1 and outer paper sheets P2 and is provided at an upper part of a left side of the printing mechanism 10.

A conveying path consists of a printing conveying path 20, an outer paper sheet feeding conveying path 22, an inner paper sheet feeding conveying path 24, a switchback conveying path 26, and a communication conveying path 28.

The printing conveying path 20 is a looped conveying path for conveying inner paper sheets P1 and outer paper sheets P2 so as to enclose the printing mechanism 10. The outer paper sheet feeding conveying path 22 is a conveying path for conveying outer paper sheets P2 to the printing mechanism 10, and is provided between the outer paper sheet feeding unit 14 and the printing conveying path 20. The inner paper sheet feeding conveying path 24 is a conveying path for conveying inner paper sheets P1 to the printing mechanism 10, and is provided between the inner paper sheet feeding unit 16 and the printing conveying path 20.

The switchback conveying path 26 is a conveying path for conveying to a side of the printing mechanism 10 inner paper sheets P1 and outer paper sheets P2 and reversing a front and rear thereof, and is provided from a left part of the printer 4 toward an inside of the cassette 18. Abase end side (a right end side) of the switchback conveying path 26 is configured to be connectable and disconnectable to the printing conveying path 20 by an operation of a publicly-known flapper for a switchback (not illustrated).

The communication conveying path 28 is a conveying path for conveying inner paper sheets P1 and outer paper sheets P2 that were sent out from the printing conveying path 20 to a post-processing apparatus 6 (a rightward direction). Abase end side (a left end side) of the communication conveying path 28 is configured to be connectable and disconnectable to the printing conveying path 20 by an operation of a publicly-known flapper for a communication (not illustrated). Over a position along each of the conveying paths mentioned above, a plurality of pairs of conveying rollers (not illustrated) that sandwich and convey the inner paper sheets P1 and outer paper sheets P2 are provided at intervals.

The post-processing apparatus 6 has an inner paper sheet loading unit 40, a stock tray 42, a cutting mechanism (a cutting unit) 44, a wrapped-binding mechanism 50, an ejection conveyor 58, a receiving box 60, and the like. The inner paper sheet loading unit 40 loads a volume equivalent to one booklet of a plurality of printed inner paper sheets and is provided at an upper part of a right side of the post-processing apparatus 6. An inner paper sheet loading unit 40 matches printed inner paper sheets P1 to form a paper sheet bundle PS. The inner paper sheet loading unit 40 further sends out, to a side of the wrapped-binding mechanism 50, the paper sheet bundle PS formed by rotating around a horizontal rotating shaft.

The stock tray 42 lets the printed inner paper sheets P1 temporarily stand by before they are sent to the inner paper sheet loading unit 40, and the stock tray 42 is provided at a center of an upper part of the post-processing apparatus 6.

The cutting unit 44 cuts the printed inner paper sheets P1 that were sent out from the printer 4 to a finishing dimension, or cuts the printed outer paper sheets P2 that were sent out from the stock tray 42 to a dimension in accordance with a thickness of the paper sheet bundle PS. The cutting unit 44 is provided at a left side of the stock tray 42. The cutting unit 44 further includes a pair of cutters that cuts the printed inner paper sheets P1 and outer paper sheets P2 in such a way as to sandwich the printed inner paper sheets P1 and outer paper sheets P2 interposing a later-mentioned upper bookbinding conveying path 72 therebetween.

The wrapped-binding mechanism 50 binds the paper sheet bundle PS that was sent out from the inner paper sheet loading unit 40 in a state of being wrapped (one embodiment of a covered state) by the printed outer paper sheets P2 that were sent out from the cutting unit 44. The wrapped-binding mechanism 50 has a pair of conveying clampers 52, an adhesive accumulation 54, a pair of bending members 56, and the like. The wrapped-binding mechanism 50 is also referred to as a book-binding mechanism.

The pair of conveying clampers 52 clamps a paper sheet bundle PS and move the clamped paper sheet bundle PS in appropriate directions (including leftward and rightward directions). The pair of conveying clampers 52 move the paper sheet bundle PS to an application position AP at which a hot melt adhesive is applied to aback face of the paper sheet bundle PS and to a joint position JP at which a printed outer paper sheet P2 is joined to a back face of the paper sheet bundle PS. The pair of conveying clampers 52 are configured to receive a paper sheet bundle that was sent out from the inner paper sheet loading unit 40 by a publicly-known receiving means.

The adhesive accumulation 54 is configured to apply a hot melt adhesive to a back face of the paper sheet bundle PS and is provided at an obliquely lower side of the inner paper sheet loading unit 40. An adhesive accumulation 54 is provided with a container for reserving the hot melt adhesive, and inside of the adhesive accumulation 54, with an application roller 61 for applying the hot melt adhesive to a back face of the paper sheet bundle PS in which the position thereof has been determined at the application position AP.

Further, the adhesive accumulation 54 is provided with a brush (not illustrated) for performing rough processing on a back face of the paper sheet bundle PS before positioning the paper sheet bundle PS at the application position AP.

The pair of bending members 56 bend both sides of the printed outer paper sheet P2 such that they wrap the paper sheet bundle PS while joining a center position of the back face of the printed outer paper sheet P2 to the back face of the paper sheet bundle PS positioned at the joint position JP. A pair of bending members 56 are provided slidably (or fluctuatably) in a vertical direction. In the meantime, the pair of bending member 56 may be slidable in a vertical direction instead of being fluctuatable in a vertical direction.

An ejection conveyor 58 conveys the booklet B sent out from the wrapped-binding mechanism 50 in a rightward direction and ejects the booklet B to a receiving box 60. The ejection conveyor 58 is provided at an outlet side of the wrapped-binding mechanism 50 (an outlet side of the bookbinding processing mechanism). The receiving box 60 is a box that stores a plurality of booklets B prepared by the wrapped-binding mechanism 50 by piling them up, and is provided on a lower stage of the post-processing apparatus 6.

The post-processing apparatus 6 has an introducing conveying path 70, an upper bookbinding conveying path 72, and a lower bookbinding conveying path 74 as conveying paths.

The introducing conveying path 70 is configured to convey, to the inside of the post-processing apparatus 6, printed inner paper sheets P1 and outer paper sheets P2 that were sent out from the communication conveying path 28 of the printer 4. A base end part (a left end part) of the introducing conveying path 70 is provided by being connected to a tip end part (a right end part) of the communication conveying path 28.

The upper bookbinding conveying path 72 is configured to convey the inner paper sheets P1 and outer paper sheets P2 sent out from the introducing conveying path 70 in the direction of an inner paper sheet loading unit 40. A base end part of the upper bookbinding conveying path 72 is configured to be connectable and disconnectable to a tip part (a right end part) of the introducing conveying path 70 by an operation of a publicly-known flapper for upper bookbinding.

The lower bookbinding conveying path 74 is configured to convey, to the wrapped-binding mechanism 50, the printed outer paper sheets P2 sent out from the upper bookbinding conveying path 72, and is provided at a lower side of the upper bookbinding conveying path 72. A base end part of the lower bookbinding conveying path 74 is configured to be connectable and disconnectable to a base end part of the upper bookbinding conveying path 72 by an operation of a publicly-known flapper for lower bookbinding (not illustrated).

In addition, in each of the conveying paths of the post-processing apparatus 6, a plurality of pairs of conveying rollers (not illustrated) that sandwich and convey printed inner paper sheets P1 and outer paper sheets P2 are provided with a spacing. Further, a pair of rollers positioned at a left side of the stock tray 42 are configured to be able to convey the printed outer paper sheets P2 by reversing the conveying direction thereof.

A path through which the printed inner paper sheets P1 are conveyed to the inner paper sheet loading unit 40 (represented by alternate long and short dashed lines) is also referred to as a first conveying path Q1, a path through which the printed outer paper sheets P2 are conveyed to the wrapped-binding mechanism 50 (represented by dashed lines) is also referred to as a second conveying path Q2, and a path through which the paper sheet bundle PS is conveyed from the inner paper sheet loading unit 40 to the joint position JP (represented by alternating one long and two short dashed lines) is also referred to as a third conveying path Q3.

Figure 2:
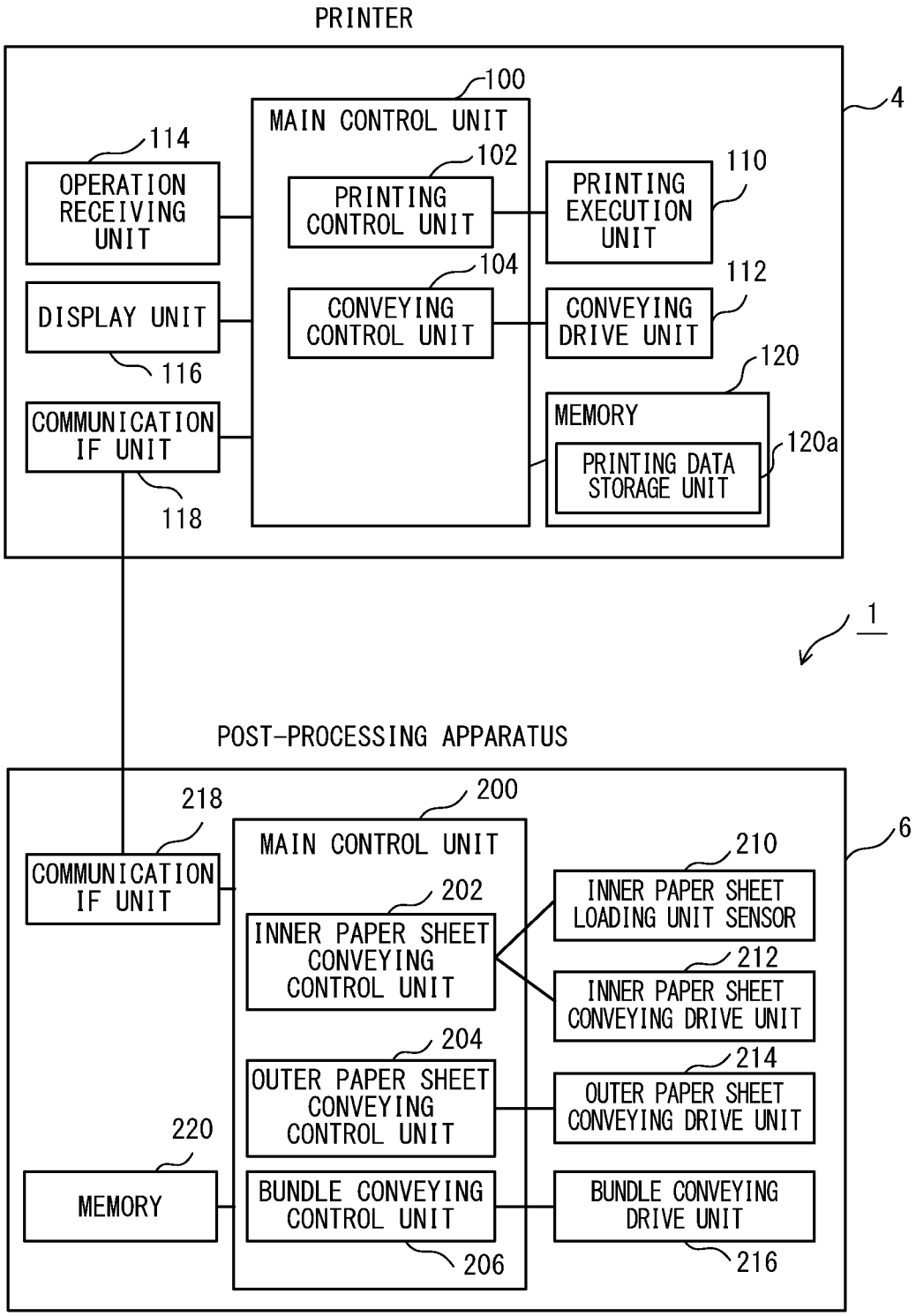
FIG. 2 illustrates a main block diagram of a printer 4 and a post-processing apparatus 6.

FIG. 2 illustrates a main block diagram of the printer 4 and the post-processing apparatus 6. The printer 4 has a main control unit 100, a printing execution unit 110, a conveying drive unit 112, an operation receiving unit 114, a display unit 116, a communication IF unit 118, a memory 120, and the like.

The main control unit 100 is a control unit that integrally controls an entire printer 4. The main control unit 100 has a CPU, and as the CPU reads and executes a control program stored in the memory 120, the main control unit 100 controls each unit of the printer 4.

The printing execution unit 110 has the printing mechanism 10 and prints images or characters on the paper sheet by driving an image-line type ink head 10K and the like, on the basis of printed data that corresponds to each color head. The conveying drive unit 112 includes a driving source that drives conveying rollers that are appropriately arranged in the outer paper sheet feeding unit 14, the inner paper sheet feeding unit 16, or each conveying path, and a driving circuit.

The operation receiving unit 114 has various kinds of operation keys that include a start key for starting reading, printing, or the like, a stop key for stopping reading, printing, or the like, and a numeric key for inputting a number of prints, and reports to the main control unit 100 an operation signal that is based on a user operation.

The display unit 116 is configured to display a state of the printer 4 (a number of paper sheets, a shortage of ink), operation guidance, or an input instruction from an operator, and the display unit 116 includes an LCD and the like. The communication IF unit 118 transmits and receives data between the printer 4 and an external device (in this embodiment, the post-processing apparatus 6) connected to the printer 4. The memory 120 stores a control program and various kinds of data and has a printing data storage unit 120*a* that stores printing data.

The main control unit 100 has a printing control unit 102, a conveying control unit 104, and the like, as a function unit that is executed by a CPU. The printing control unit 102 controls driving of each head, according to printing data. The conveying control unit 104 controls a conveying drive unit 112 and controls a conveyance of paper sheets.

Further, the main control unit 100 manages, with a control number, each one of the inner paper sheets P1 and the outer paper sheets P2 to be printed and sent out to the post-processing apparatus 6. The main control unit 100 reports, to the post-processing apparatus 6, a corresponding control number in accordance with a delivery of the inner paper sheets P1 and the outer paper sheets P2.

The main control unit 100 numbers the inner paper sheets P1 with a "page number" or "page number and type of booklet or booklet number" as control numbers. A type of a booklet is information for distinguishing booklets when, for example, different booklets are printed collectively, and the type of a booklet is represented by for example A, B, and C. The booklet number is a sequential serial number (1, 2, . . . ) of the booklet that is printed.

The main control unit 100 numbers the outer paper sheets P2 with the booklet number as a control number. The main control unit 100 needs to manage via a sequential serial number the order of the outer paper sheet P2, although the image itself of the outer paper sheet P2 is the same.

The post-processing apparatus 6 has a main control unit 200, an inner paper sheet loading unit sensor 210, an inner paper sheet conveying drive unit 212, an outer paper sheet conveying drive unit 214, a bundle conveying drive unit 216, a communication IF unit 218, a memory 220, and the like.

The main control unit 200 is a control unit that integrally controls the entire post-processing apparatus 6. The main control unit 200 has a CPU, and as the CPU reads and executes a control program stored in the memory 220, the main control unit 200 controls each unit of the post-processing apparatus 6.

The inner paper sheet loading unit sensor 210 detects whether or not the printed inner paper sheets P1 are loaded into the inner paper sheet loading unit 40, and it is a reflection-type optical sensor, for example. A detection signal of the inner paper sheet loading unit sensor 210 is reported to the main control unit 200.

The inner paper sheet conveying drive unit 212 includes a driving source that drives conveying rollers that are appropriately arranged in the introducing conveying path 70 and the upper bookbinding conveying path 72 and conveys the printed inner paper sheets P1 to the inner paper sheet loading unit 40, and a driving circuit. The outer paper sheet conveying drive unit 214 includes a driving source that drives conveying rollers that are appropriately arranged in the introducing conveying path 70 and the lower bookbinding conveying path 74 and conveys the printed outer paper sheets P2 to the binding position of the wrapped-binding mechanism 50, and a driving circuit.

The bundle conveying drive unit 216 is a driving source that drives the pair of conveying clampers 52 and a driving circuit. The communication IF unit 218 transmits and receives data between the post-processing apparatus 6 and the printer 4. The memory 220 stores the control program and data.

A main control unit 200 has an inner paper sheet conveying control unit 202, an outer paper sheet conveying control unit 204, and a bundle conveying control unit 206, as a function unit that is executed by a CPU. The inner paper sheet conveying control unit 202 controls the inner paper sheet conveying drive unit 212 and conveys the printed inner paper sheets P1 through the introducing conveying path 70 and the upper bookbinding conveying path 72 to the inner paper sheet loading unit 40. The inner paper sheet conveying control unit 202 detects a presence or absence of the inner paper sheets P1 in the inner paper sheet loading unit 40 via the inner paper sheet loading unit sensor 210. The inner paper sheet conveying control unit 202 detects that a conveyance by the first conveying path Q1 of the printed inner paper sheets P1 has ended via a sensor (not illustrated) provided in the inner paper sheet loading unit 40.

The outer paper sheet conveying control unit 204 controls the outer paper sheet conveying drive unit 214, and conveys the printed outer paper sheets P2 to the binding position of the wrapped-binding mechanism 50, through the introducing conveying path 70 and the lower bookbinding conveying path 74. The outer paper sheet conveying control unit 204 detects that a conveyance by the second conveying path Q2 of the printed outer paper sheets P2 has ended via a sensor provided at the binding position of the wrapped-binding mechanism 50.

The bundle conveying control unit 206, when loading of the printed inner paper sheets P1 for one booklet has ended, controls the bundle conveying drive unit 216, and controls the paper sheet bundle PS loaded into the inner paper sheet loading unit 40 to let it move to an application position AP and a joint position JP. The inner paper sheet conveying control unit 202, the outer paper sheet conveying control unit 204, and the bundle conveying control unit 206 are also collectively referred to as conveying control units.

The main control unit 200 reports, to the main control unit 100, a control number (e.g., a page number) of the completed printed inner paper sheets P1 every time a conveyance of one sheet of the printed inner paper sheets P1 ends via the inner paper sheet conveying control unit 202, as information of the printed inner paper sheets P1 that were most recently loaded. As mentioned above, the control number is reported from the main control unit 100. The control number of the most recent inner paper sheet P1 loaded into the inner paper sheet loading unit 40 is also referred to as first conveyance final ejection paper sheet information.

Similarly, the main control unit 200 reports, to the main control unit 100, a control number (e.g., a sequential serial number of a booklet) of the completed outer paper sheets P2, every time a conveyance of the printed outer paper sheets P2 to the binding position of the wrapped-binding mechanism 50 ends due to the outer paper sheet conveying control unit 204 as information of the outer paper sheets P2. The control number (e.g., a sequential serial number of the booklet) of the most recent completed outer paper sheet P2 is also referred to as second conveyance final ejection paper sheet information.

In a printing system 1 mentioned so far above, the main control unit 100 controls printing of the inner paper sheets and the outer paper sheets in cooperation with the post-processing apparatus 6. In each conveying path of the post-processing apparatus 6, a sensor for detecting jamming (an abnormal conveyance) is appropriately provided, and the main control unit 200 detects occurrences of jamming via signals of a jamming detection sensor, and the like. When jamming occurs, the main control unit 200 reports it to the main control unit 100, and the main control unit 100 stops printing. When a jam is released, the main control unit 200 reports, to the main control unit 100, and the main control unit 100 restarts printing.

The main control unit 100, when restarting printing after a release of a jam of the outer paper sheets P2 or the inner paper sheets P1 that has occurred inside of the post-processing apparatus 6, sets printing restart information of the inner paper sheets that is a print restarting point of the inner paper sheets P1 and printing restart information of the outer paper sheets that is a print restarting point of the outer paper sheets P2 on the basis of first conveyance final ejection paper sheet information and second conveyance final ejection paper sheet information, and restarts printing in accordance with the setting. Explanations are given for details of setting of the printing restart information on the basis of first conveyance final ejection paper sheet information and second conveyance final ejection paper sheet information, in reference to the flowchart of FIG. 4.

Figure 3:
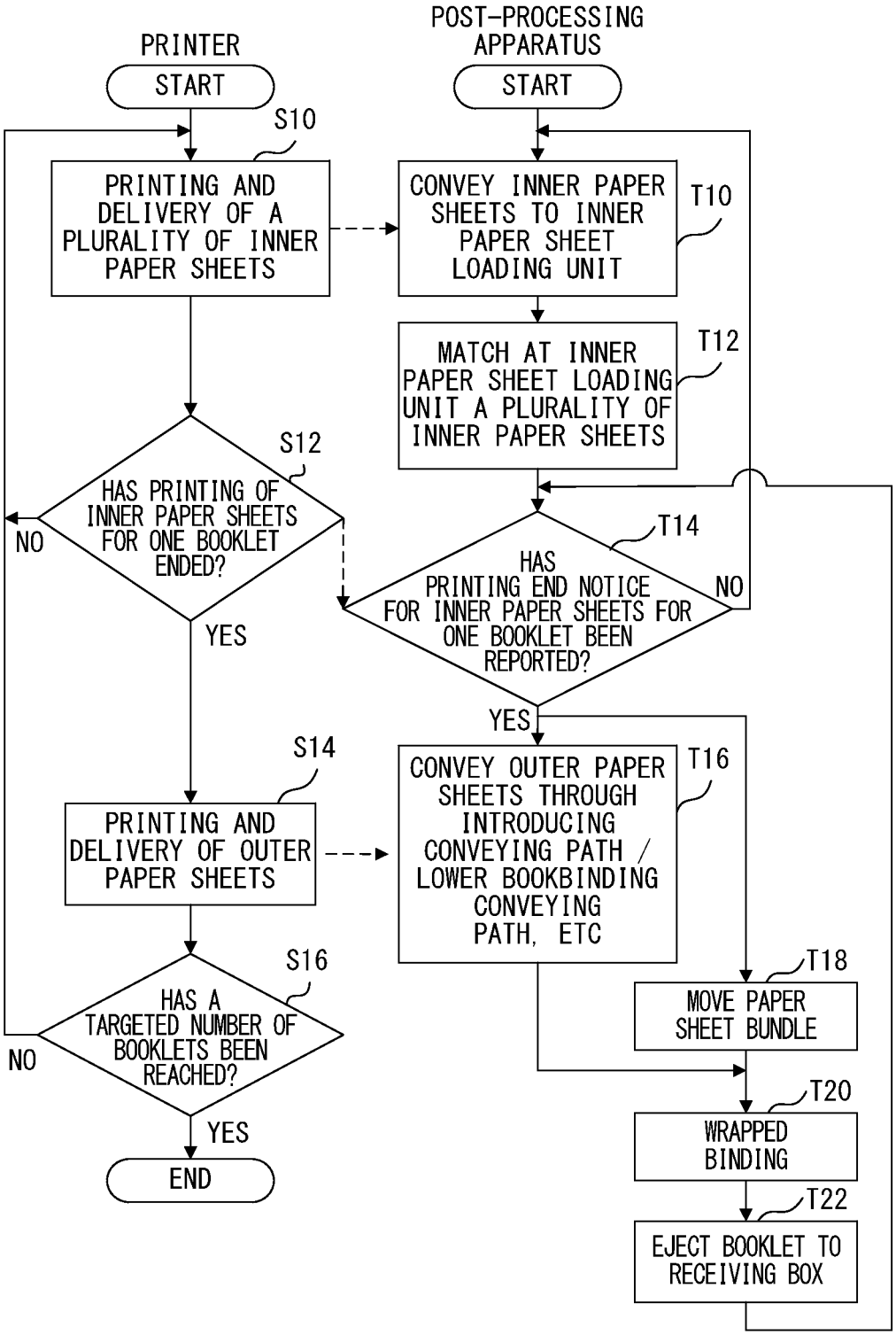
FIG. 3 is a flowchart that illustrates a schematic procedure of processing from printing to a wrapped binding.

FIG. 3 is a flowchart that illustrates a schematic procedure of processing from printing to a wrapped binding. Processing at a left row of the flowchart (represented by step S) is processing by the printer 4, and processing at a right row of the flowchart (represented by step T) is processing by the post-processing apparatus 6. Processing by the printer 4 is mainly executed by the main control unit 100, and processing by the printer 6 is mainly executed by the main control unit 200. Printing starts when a printing job is specified by the operator.

The main control unit 100 performs printing and delivery of a plurality of inner paper sheets P1 (step S10). Printing and delivery of the inner paper sheets P1 of a booklet B are performed earlier. The inner paper sheets P1 are printed starting from a top page or a final page, and the printed inner paper sheets P1 are sent out through the communication conveying path 28 to the post-processing apparatus 6. At the post-processing apparatus 6, each one of the printed inner paper sheets P1 sent out from the printer 4 is conveyed to the inner paper sheet loading unit 40 through the upper bookbinding conveying path 72 (step T10), and at the inner paper sheet loading unit 40, each inner paper sheet P1 is matched as a plurality of inner paper sheets P1 (step T12). The printed inner paper sheets P1 are loaded into the inner paper sheet loading unit 40 along with a first conveying path Q1 (the introducing conveying path 70, the upper bookbinding conveying path 72). In addition, the printed inner paper sheets P1 are cut into a specified length by the cutting unit 44 as required, and the printed inner paper sheets that were cut are loaded into the inner paper sheet loading unit 40.

The main control unit 100 of the printer 4 determines whether or not printing of the inner paper sheets P1 for one booklet has ended (step S12). When the main control unit 100 of the printer 4 determines that printing of the inner paper sheets P1 for one booklet has not ended (NO in step S12), the process returns to step S10 and performs printing and delivery of a following page of the inner paper sheets P1.

When the main control unit 100 of the printer 4 determines that printing of the inner paper sheets P1 for one booklet has ended (YES in step S12), it performs printing and delivery of the outer paper sheets P2 (step S14). At the same time, the main control unit 100 of the printer 4 reports, to the main control unit 200 of the post-processing apparatus 6, printing end information of the inner paper sheets for one booklet.

The main control unit 200 of the post-processing apparatus 6 determines whether or not the main control unit 200 of the post-processing apparatus 6 has received a printing end notice for the inner paper sheets for one booklet (step T14). When the main control unit 200 of the post-processing apparatus 6 determines that it has not received the printing end notice for the inner paper sheets for one booklet (NO in step T14), the process returns to step T10.

When the control unit 200 of the post-processing apparatus 6 determines that it has received, from the printer 4, the printing end notice for the inner paper sheets for one booklet (YES in step T14), it moves the paper sheet bundle PS (step T18). The bundle conveying control unit 206 drives the bundle conveying drive unit 216, sandwiches the paper sheet bundle PS with the pair of conveying clampers 52, and moves from the inner paper sheet loading unit 40 to the application position AP. An adhesive is applied to a back face of the paper sheet bundle PS at the application position AP. The bundle conveying control unit 206 moves the paper sheet bundle PS to which an adhesive has been applied to the joint position JP.

The outer paper sheet conveying control unit 204 of the main control unit 200 conveys the printed outer paper sheets P2 sent out from the printer 4 in step S14 through the introducing conveying path 70, the upper bookbinding conveying path 72, and the lower bookbinding conveying path 74 (step T16). In addition, the printed outer paper sheets P2 are cut into a specified length by the cutting unit 44 as required. The outer paper sheet conveying control unit 204 conveys the printed outer paper sheets P2 to the binding position of the wrapped-binding mechanism 50.

The outer paper sheets P2 printed on a back face of the paper sheet bundle PS are joined to perform a wrapped binding (step T20). Both sides of the printed outer paper sheet P2 are bent by the pair of bending members 56 so as to wrap the paper sheet bundle PS, and the booklet B is manufactured.

The manufactured booklet B is ejected to the receiving box 60 (step T22). The booklet B sent out from the wrapped-binding mechanism 50 is ejected to the receiving box 60. After the booklet B is ejected, the process returns to step T14.

After step S14 has ended, the main control unit 100 of the printer 4 determines whether or not a targeted number of booklets has been achieved (step S16). The main control unit 100 determines whether or not the number of manufactured booklets B has reached a prescribed number of booklets. When the main control unit 100 determines that a targeted number of booklets has been achieved (YES in step S16), it ends a printing job. When the main control unit 100 determines that the targeted number of booklets has not been achieved (NO in step S16), the process returns to step S20, and starts printing of the inner paper sheets P1 for the following booklet B.

The inner paper sheets P1 printed for the following booklet B are sent out to the post-processing apparatus 6. Then, the main control unit 200 of the post-processing apparatus 6 performs processing of loading the inner paper sheets P1 printed for the following booklet B on the inner paper sheet loading unit 40, in parallel with the conveyance (step T16) or the wrapped binding (step T20) of the printed outer paper sheets P2. Namely, the main control unit 200 performs control so that there is at least some overlap of parts of a conveyance time period during which the printed outer paper sheets P2 are conveyed to the wrapped-binding mechanism 50 and a conveyance time period during which the printed inner paper sheets P1 are loaded into the inner paper sheet loading unit 40.

Figure 4A:
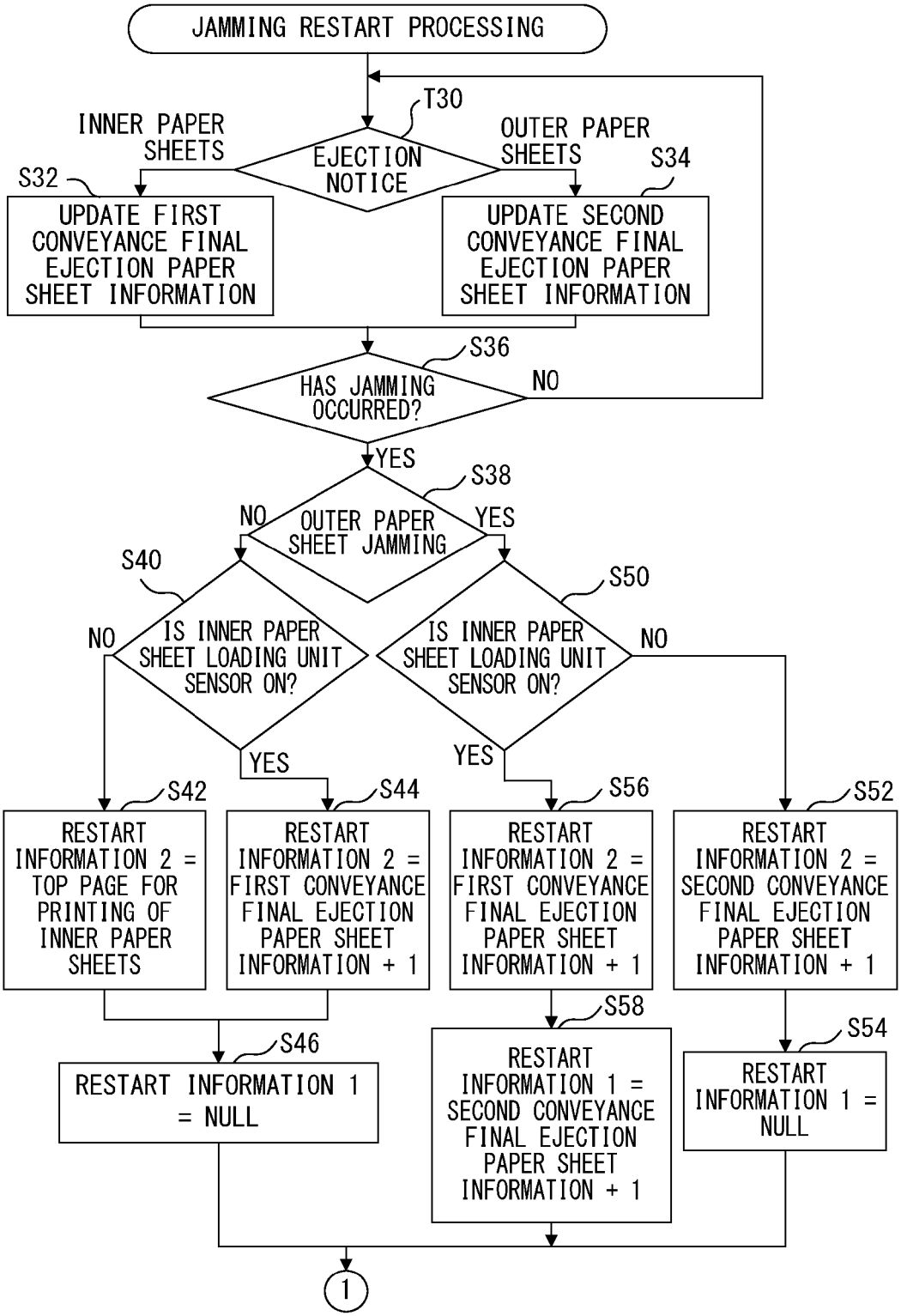
FIG. 4A is a flowchart 1 that explains a procedure of restart processing after jamming has occurred.
Figure 4B:
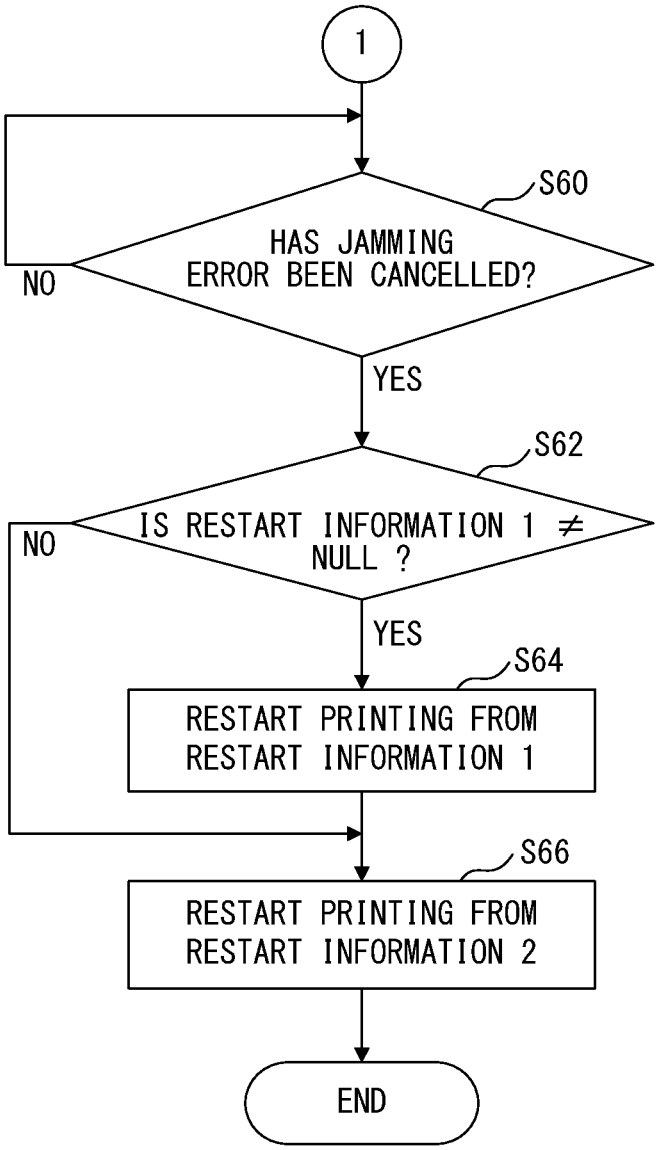
FIG. 4B is a flowchart 2 that explains a procedure of restart processing after jamming has occurred.

FIG. 4 is a flowchart that explains a procedure of restart processing after jamming has occurred. FIG. 4A corresponds to a flowchart 1, and FIG. 4B corresponds to a flowchart 2. In some cases, the abnormal conveyance (e.g., jamming) occurs while conveying the printed inner paper sheets P1 and the outer paper sheets P2 in the post-processing apparatus 6. When the paper sheets to which jamming occurred have been removed by the operator and when the printer 4 receives a notice of the removal from the post-processing apparatus 6 (a jamming error cancellation notice), the printer 4 performs restart processing illustrated in FIG. 4, in accordance with the situation of the paper sheets to which jamming has occurred and the situation of the conveyance. Processing illustrated in FIG. 4 is mainly executed by the main control unit 100 of the printer 4.

The main control unit 200 of the post-processing apparatus 6 sends, to the main control unit 100, information of the first conveyance final ejection paper sheet as an ejection notice, when the printed inner paper sheets P1 finish being conveyed to the inner paper sheet loading unit 40. Similarly, the main control unit 200 sends, to the main control unit 100, information of the second conveyance final ejection paper sheet as the ejection notice, when the printed outer paper sheets P2 finish being conveyed to the binding position of the wrapped-binding mechanism 50 (step T30).

The main control unit 100 of the printer 4 receives the ejection notice from the main control unit 200 of the post-processing apparatus 6. The main control unit 100, upon receiving information of the first conveyance final ejection paper sheet for the printed inner paper sheets P1, updates information of the first conveyance final ejection paper sheet (step S32). As mentioned above, the information of the first conveyance final ejection paper sheet is the control number (e.g., a page number) of the most recent inner paper sheet P1 for which the conveyance to the inner paper sheet loading unit 40 has ended. The main control unit 100 stores, in the memory 120, information of the first conveyance final ejection paper sheet.

Similarly, the main control unit 100, upon receiving information of the second conveyance final ejection paper sheet for the printed outer paper sheets P2, updates information of the second conveyance final ejection paper sheet (step S34). The main control unit 100 stores, in the memory 120, the control number (e.g., a sequential serial number of the booklet) of the most recent outer paper sheet P2 for which a conveyance to the binding position of the wrapped-binding mechanism 50 has ended.

The main control unit 100 determines whether or not jamming has occurred at the post-processing apparatus 6 via a notice from the post-processing apparatus 6 (step S36). When the main control unit 100 determines that no jamming has occurred (NO in step S36), the process returns to step T30.

When the main control unit 100 determines that jamming has occurred (YES in step S36), it determines whether or not the printed outer paper sheets P2 have been jammed (step S38). When the main control unit 100 determines that the printed outer paper sheets P2 have not been jammed (NO in step S38), namely, when it determines that the printed outer paper sheets P1 have been jammed, it determines whether or not the inner paper sheet loading unit sensor 210 is ON (step S40). Whether or not the inner paper sheet loading unit sensor 210 is ON is reported from the inner paper sheet conveying control unit 202 to the main control unit 100.

When the main control unit 100 determines that the inner paper sheet loading unit sensor 210 is not ON (NO in step S40), it moves on to step S42. That the inner paper sheet loading unit sensor 210 is not ON means that not a single printed inner paper sheet P1 is loaded into the inner paper sheet loading unit 40 and that jamming has occurred at a top page of the printed inner paper sheets P1.

The main control unit 100 sets "restart information 2=a top page for the printing of inner paper sheets" (step S42). The restart information is information of printing that is restarted after jamming has been resolved, and it has two pieces of information, restart information 1 and restart information 2. The restart information 1 is restart information for which printing is executed earlier, and the restart information 2 is restart information for which printing is executed later. Namely, printing of the restart information 2 is executed after printing of the restart information 1 is executed. The main control unit 100 stores, in the memory 120, the restart information 1 and the restart information 2. Namely, as the restart information 2, a top page of the printing of the inner paper sheets P1 is set. In the meantime, "the top page for a printing of inner paper sheets" means a top page of the inner paper sheets P1 for printing, and does not necessarily mean a top page of the booklet but may be a last page of the booklet.

Next, the main control unit 100 sets restart information 1=NULL (step S46). Namely, nothing is set as restart information 1. The reason is that since the top page of the printed inner paper sheets P1 has jammed, after the jamming has been resolved, the printing may be similarly restarted from the top page of the printed inner paper sheets P1. In this case, there may only be one restart point.

The main control unit 100, when the process returns to step S40 and determines that the inner paper sheet loading unit sensor 210 is ON (YES in step S40), moves on to step S44. This case is the case in which jamming has occurred at the inner paper sheets P1 in the middle of the page. The main control unit 100 sets "restart information 2=the first conveyance final ejection paper sheet number+1" (step S44). Since the page number of the jammed inner paper sheets P1 corresponds to "a first conveyance final ejection paper sheet information+1", after jamming has been resolved, printing may be restarted from the page of the inner paper sheets P1 of the first conveyance final ejection paper sheet information+1.

For example, when information of the first conveyance final ejection paper sheet is "6", this means that the seventh page of the inner paper sheets P1 has jammed, and therefore, printing may be restarted from the seventh page of the inner paper sheets P1. Further, the main control unit 100 sets restart information 1=NULL (step S46).

The main control unit 100, when the process returns to step S38 and determines that the printed outer paper sheets P2 have jammed (YES in step S38), determines whether or not the inner paper sheet loading unit sensor 210 is ON (step S50). When it determines that the inner paper sheet loading unit sensor 210 is not ON (NO in step S50), it sets restart information 2=the second conveyance final ejection paper sheet information+1 (step S52), and further sets restart information 1=NULL (step S54).

Second conveyance final ejection paper sheet information+1 is the situation in which the outer paper sheet P2 subsequent to the outer paper sheets P2 for which the conveyance to the binding position of the wrapped-binding mechanism 50 has ended, and it refers to actually jammed outer paper sheet P2, in other words. Namely, it is executing printing from the jammed outer paper sheet P2 once again. For example, when second conveyance final ejection paper sheet information is "4", namely, when it is the fourth booklet, printing may be restarted from the outer paper sheets P2 of the fifth booklet.

Further, since no inner paper sheet P1 exists in the inner paper sheet loading unit 40, it is not necessary to set restart information for the printing of the inner paper sheets P1, and accordingly, the main control unit 100 sets restart information 1=NULL.

The main control unit 100, when the process returns to step S50 and determines that the inner paper sheet loading unit sensor 210 is ON (YES in step S50), sets restart information 2=first conveyance final ejection paper sheet information+1 (step S56). Restart information 2 is a restart setting for a first conveyance, or a restart setting for the inner paper sheets P1, and is a direction to restart printing from the page that is subsequent to the inner paper sheets P1 that are currently loaded into the inner paper sheet loading unit 40.

The main control unit 100 further sets restart information 1=second conveyance final ejection paper sheet information+1 (step S58). Restart information 1 is the restart setting for a second conveyance, or the restart setting for the outer paper sheets P2, and it refers to the outer paper sheets P2 that are subsequent to the outer paper sheets P2 for which the conveyance to the binding position of the wrapped-binding mechanism 50 has ended, and namely, the actually jammed outer paper sheets P2. In other words, the restart information 1 is an instruction to restart printing from the jammed outer paper sheets P2.

Next, explanations are given for FIG. 4B. The main control unit 100 determines whether or not jamming errors have been cancelled (step S60). The main control unit 100 determines the jamming error cancellation by a jamming error cancellation notice from the main control unit 200. When the main control unit 100 determines that the jamming errors have not been cancelled (NO in step S60), it loops step S60.

When the main control unit 100 determines that the jamming errors have been cancelled (YES in step S60), it determines whether or not restart information 1≠NULL (step S62). When the main control unit 100 determines that restart information 1≠NULL (YES in step S62), it restarts printing from restart information 1 (step S64).

The case in which restart information 1≠NULL is the state in which the inner paper sheets P1 are loaded into the inner paper sheet loading unit 40 and in which the outer paper sheets P2 have jammed. This occurs only in the case of YES in step S50.

In this case, in step S64, the main control unit 100 restarts printing from restart information 1; namely, it restarts printing from the jammed outer paper sheets P2. Subsequently, the main control unit 100 restarts printing from restarting information 2; namely, it restarts printing from the page that is subsequent to the inner paper sheets P1 that have been loaded into the inner paper sheet loading unit 40 most recently (step S66).

On the other hand, when the main control unit 100 does not determine that restart information 1≠NULL (NO in step S62), namely, when restart information 1=NULL, it skips step S64 and restarts printing from restart information 2 (step S66). This is the case that corresponds to step S46 or step S54.

When the inner paper sheets P1 have jammed in a state in which no inner paper sheet P1 is loaded into the inner paper sheet loading unit 40, as in step S42, the main control unit 100 restarts printing from a top of the inner paper sheets P1. When the inner paper sheets P1 have been jammed in a state in which inner paper sheets P1 are loaded into the inner paper sheet loading unit 40, as in step S44, the main control unit 100 restarts printing from a jammed page of the inner paper sheets P1.

Further, when the outer paper sheets P2 have been jammed in a state in which no inner paper sheets P1 are loaded into the inner paper sheet loading unit 40, as in step S52, the main control unit 100 restarts printing from a number of the outer paper sheets P2 which was jammed, and subsequently starts printing the inner paper sheets P1 as usual, from the top.

As mentioned above, by providing a total of two pieces of information of restart points corresponding to the inner paper sheets P1 and the outer paper sheets P2, printing may be restarted from appropriate numbers (positions) respectively for the inner paper sheets P1 and the outer paper sheets P2.

For example, even when the outer paper sheets P2 are reprinted in the middle of the printing of the inner paper sheets P1, no paper sheets are wasted, since disposing of the inner paper sheets in the middle of the printing is no longer required in the configuration in which the printing of the inner paper sheets is restarted subsequent to the printing of the outer paper sheets.

Although explanations have been given for jamming as a representative example of abnormal conveyance, abnormal conveyance are not limited to jamming and may include other troubles. Although explanations have been given for control processing by the printer 4 as software processing by a CPU, some or all of the control processing may be configured by hardware.

In the meantime, the present invention is not limited to the above mentioned embodiments as they are, but may be embodied in practical uses, by modifying components without departing from a gist of the embodiments. Further, by appropriately combining a plurality of components disclosed in the above mentioned embodiments, various inventions may be configured. For example, all of the components disclosed in the embodiments may be combined as appropriate. Further, the components may be combined appropriately over different embodiments. Within a scope of the invention that does not depart from the gist of the invention, various modifications or applications are possible, as a matter of course.

EXPLANATIONS OF LETTERS OR NUMERALS

1 printing system
4 printer
6 post-processing apparatus
10 printing mechanism
12 printing conveying path
14 outer paper sheet feeding unit
40 inner paper sheet loading unit
50 wrapped-binding mechanism
70 introducing conveying path
72 upper bookbinding conveying path
74 lower bookbinding conveying path
100 main control unit
102 printing control unit
104 conveying control unit
110 printing execution unit
112 conveying drive unit
114 operation receiving unit
116 display unit
118 communication IF unit
120 memory
200 main control unit
202 inner paper sheet conveying control unit
204 outer paper sheet conveying control unit
206 bundle conveying control unit
210 inner paper sheet loading unit sensor
212 inner paper sheet conveying drive unit
214 outer paper sheet conveying drive unit
216 bundle conveying drive unit
218 communication IF unit

What is claimed is:

1. A printer which is connected to a post-processing apparatus, the post-processing apparatus performing a wrapped binding in which a paper sheet bundle including a plurality of inner paper sheets is wrapped by outer paper sheets, and which prints the outer paper sheets and the inner paper sheets to be sent out to the post-processing apparatus, wherein:

a conveying control unit configured to perform control such that there is at least some overlap of parts of a conveyance time period during which the outer paper sheets that were printed are conveyed to a wrapped-binding mechanism and a conveyance time period during which the inner paper sheets that were printed are loaded into an inner paper sheet loading unit is provided in the post-processing apparatus;

the printer includes a control unit configured to control printing of the inner paper sheets and the outer paper sheets in cooperation with the post-processing apparatus; and the control unit sets printing restart information of the inner paper sheets that is a print restarting point of the inner paper sheets and printing restart information of the outer paper sheets that is a print restarting point of the outer paper sheets, and controls a restarting of printing in accordance with the setting, when printing is restarted under a condition in which there is at least some overlap of parts of the conveyance time periods and after an abnormal conveyance of the outer paper sheets or the inner paper sheets that occurred inside of the post-processing apparatus has been resolved.

2. The printer according to claim 1, wherein the control unit manages, with a control number, each one of the inner paper sheets and the outer paper sheets to be printed and sent to the post-processing apparatus, printing restart information of the inner paper sheets is information regarding a control number of the inner paper sheets for which printing should be restarted, and printing restart information of the outer paper sheets is information regarding a control number of the outer paper sheets for which printing should be restarted.

3. The printer according to claim 2, wherein when the abnormal conveyance has occurred to the outer paper sheets in the middle of loading into the inner paper sheet loading unit of the inner paper sheets, the printing control unit sets, as printing restart information of the inner paper sheets, a control number subsequent to the inner paper sheet that was loaded into the inner paper sheet loading unit most recently, and sets, as printing restart information of the outer paper sheets, a control number which is the same as the outer paper sheet for which the abnormal conveyance has occurred.

4. A computer-readable non-transitory storage medium having a program, wherein the program is executed by a computer of a printer which is connected to a post-processing apparatus, the post-processing apparatus performing a wrapped binding in which a paper sheet bundle including a plurality of inner paper sheets is wrapped by outer paper sheets, and which prints the outer paper sheets and the inner paper sheets to be sent out to the post-processing apparatus, a conveying control unit, configured to control such that there is at least some overlap of parts of a conveyance time period during which the outer paper sheets that were printed are conveyed to a wrapped-binding mechanism and a conveyance time period during which the inner paper sheets that were printed are loaded into an inner paper sheet loading unit, is provided in the post-processing apparatus;

the program includes control processing for controlling printing of the inner paper sheets and the outer paper sheets in cooperation with the post-processing apparatus; and the control processing has processing of setting printing restart information of the inner paper sheets that is a print restarting point of the inner paper sheets and printing restart information of the outer paper sheets that is a print restarting point of the outer paper sheets, and processing of restarting printing in accordance with the setting, when printing is restarted under a condition in which there is at least some overlap of parts of the conveyance time periods and after an abnormal conveyance of the outer paper sheets or the inner paper sheets that occurred inside of the post-processing apparatus has been resolved.

* * * * *